United States Patent [19]

Erickson et al.

[11] 4,103,133

[45] Jul. 25, 1978

[54] DUAL SWITCH OPERATOR USING MODIFIED GENEVA MOVEMENT

[75] Inventors: John Walter Erickson; John W. Erickson, both of Crystal Lake, Ill.

[73] Assignee: Boltswitch, Inc., Crystal Lake, Ill.

[21] Appl. No.: 815,543

[22] Filed: Jul. 14, 1977

[51] Int. Cl.[2] ..... B65D 3/44

[52] U.S. Cl. ..... 200/153 N; 74/820; 200/153 PA

[58] Field of Search ..... 74/74, 820; 200/5 B, 200/5 C, 18, 153 PA, 153 N, 153 V

[56] References Cited

U.S. PATENT DOCUMENTS

| | | | |
|---|---|---|---|
| 2,253,183 | 8/1941 | Count | 200/153 PA |
| 2,791,648 | 5/1957 | Maloney | 200/153 PA |
| 3,204,176 | 8/1965 | Wilson, Jr. | 200/153 PA |
| 3,764,891 | 10/1973 | Lingenfelter et al. | 200/153 PA |
| 3,794,798 | 2/1974 | Trayer | 200/153 V |

FOREIGN PATENT DOCUMENTS

| | | | |
|---|---|---|---|
| 1,279,762 | 11/1961 | France | 200/153 PA |

*Primary Examiner*—William Price
*Assistant Examiner*—Bruce H. Bernstein
*Attorney, Agent, or Firm*—Kinzer, Plyer, Dorn & McEachran

[57] ABSTRACT

A dual switch actuator mechanism for coordinated actuation of two high-current switches, each of which includes a switch operator mechanism for opening and closing the switch in response to rotation of a switch operator shaft. The switches are mounted adjacent to each other with their switch operator shafts in aligned paraxial spaced relation. The dual switch actuator mechanism includes a rotatable main shaft positioned between and in aligned paraxial relation to the switch operator shafts. A Geneva drive plate having an arcuate bearing surface is affixed to the main shaft; two drive pins are mounted on the drive plate. Two modified Geneva follower plates are provided, each affixed to one of the switch operator shafts. Each follower plate has a drive slot for receiving one of the drive pins and an arcuate bearing surface which is complementary to the drive plate bearing surface. For a given neutral position of the main shaft, each drive pin is positioned in the entrance of a follower plate drive slot and the bearing surfaces of both follower plates engage the drive plate bearing surface. Rotation of the main shaft through a predetermined angle in either direction from the neutral position causes one guide pin to move inwardly of the drive slot of one follower plate, rotating the follower plate and its associated switch operator shaft to actuate one switch without actuation of the other.

12 Claims, 9 Drawing Figures

Fig. 2.
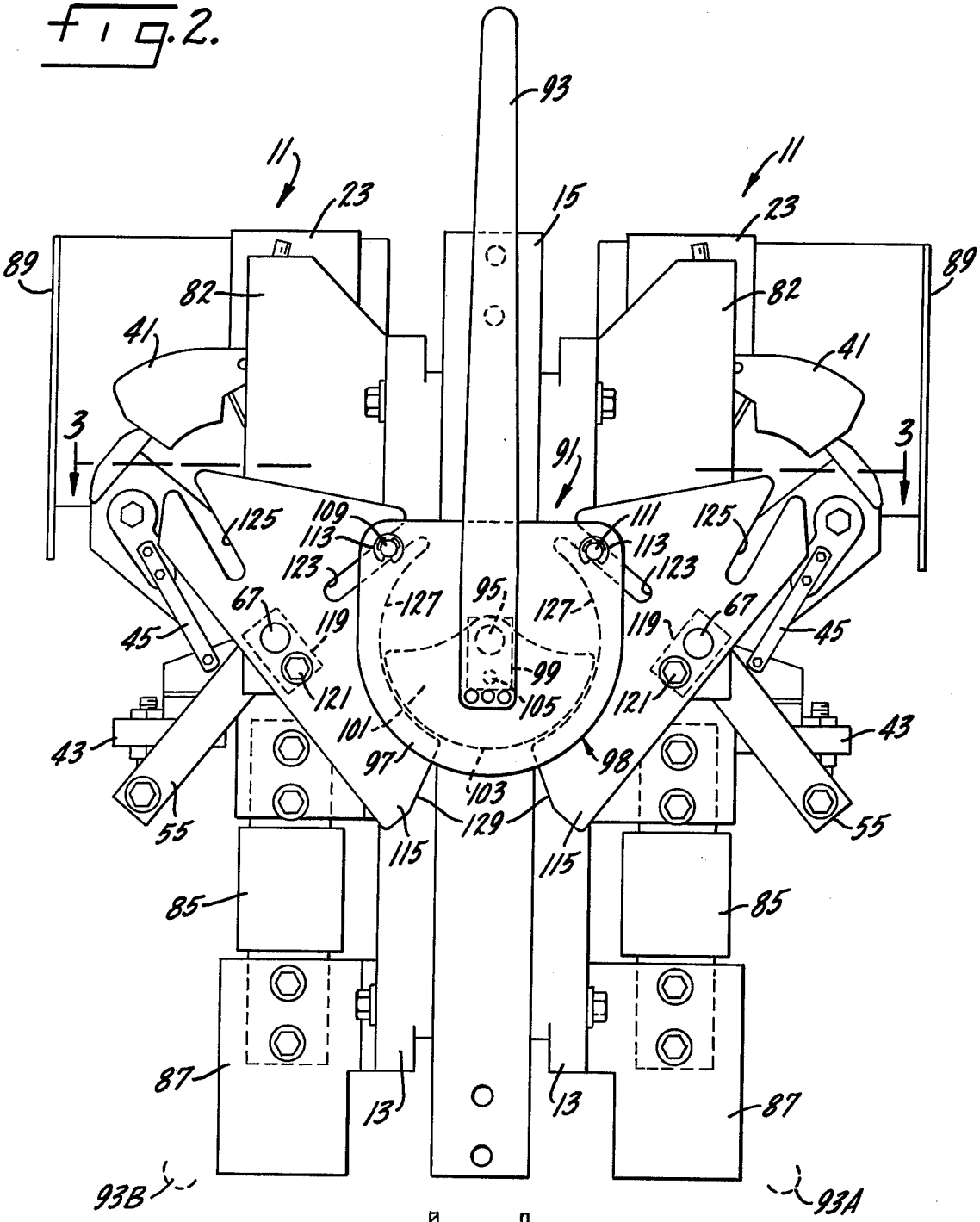
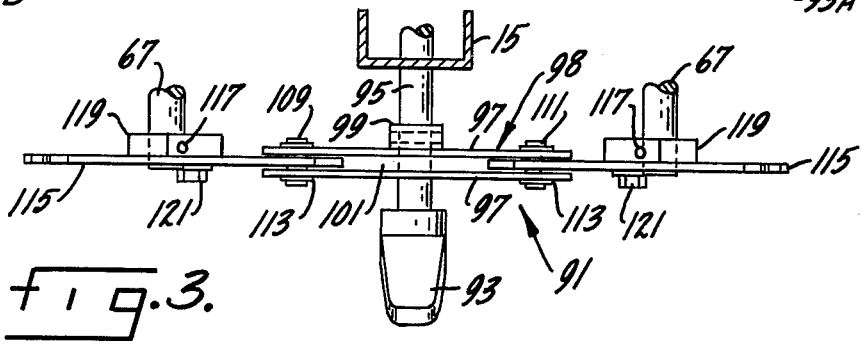
Fig. 3.

DUAL SWITCH OPERATOR USING MODIFIED GENEVA MOVEMENT

BACKGROUND OF THE INVENTION

This invention relates to an operating mechanism for high current switches which are positioned side by side or back to back, particularly load-break bolted pressure contact switches where it is necessary or desirable to operate the switches alternately, that is, to close one switch while maintaining the other switch in its open condition or to open one switch while maintaining the other switch closed.

Load-break bolted pressure contact switches are frequently used as service entrance equipment and in other relatively high current applications. Typically, switches of this type may be used in multi-pole switching operations requiring interruption under loads of currents of the order of 400 to 6,000 amperes. Frequently, these switches are positioned side by side or back to back. In such switches, it is critically important that the contacts open and close rapidly to minimize arcing and thereby avoid pitting and deterioration of the contact members. Most switches of this kind are provided with a latching mechanism for each pole of the switch to secure the contacts in closed position and to prevent any accidental opening of the switch due to external shocks or other factors. The switch blades are relatively heavy and the mechanical forces involved in opening and closing of the switch may be substantial.

Rapid opening and closing of the switch contacts is accomplished by an overcenter toggle spring mechanism which accelerates the speed of opening and closing of the switch contacts. Spring mechanisms of this type are actuated by lost motion mechanisms operatively connected between an operator's shaft and the switch contacts. These lost motion mechanisms provide manual opening of the switch contacts to a point at which disengagement is almost achieved, followed by a rapid spring actuated movement of the switch blade clear of the fixed switch contacts in order to minimize arcing.

Co-ordinated actuation of two high-current switches has not been practical with previously known mechanisms.

SUMMARY OF THE INVENTION

Thus, an object of this invention is to provide a new and improved mechanism for co-ordinated actuation of two high current switches which may be positioned side by side or back to back.

Another object of this invention is to provide a new and improved mechanism for co-ordinated actuation of two high current switches which can be adapted to various arrangements of switches, such as arrangements in which both switches are normally open, both are normally closed, or in which one is normally open and the other is normally closed.

Accordingly, the invention relates to a dual switch actuator mechanism for coordinated actuation of two high current switches of the type having a switch operator mechanism for opening and closing the switch in response to rotation of a switch operator shaft in opposite directions. The switches are mounted adjacent each other with the switch operator shafts arranged in aligned paraxial spaced relation to each other. The dual switch actuator mechanism includes a rotatable main shaft which is positioned between and in aligned paraxial relation to the two switch operator shafts. A Geneva drive plate is affixed to the main shaft for rotation therewith and it has an arcuate bearing surface. A pair of drive pins are mounted in spaced relation to each other on the Geneva drive plate. Modified Geneva follower plates are each affixed to the switch operator shaft of a respective switch mechanism. Each follower plate has a drive slot for receiving one of the drive pins. Each follower plate further has an arcuate bearing surface which is complementary to the drive plate bearing surface. The follower plates are aligned relative to the main shaft and the drive plate, so that for a given neutral position of the main shaft, each drive pin is positioned in the entrance of a follower plate drive slot and the bearing surfaces of both follower plates engage the drive plate follower surface. Rotation of the main shaft through a predetermined arc in either direction from a neutral position causes one guide pin to move inwardly of the drive slot of one follower plate to thereby rotate that follower plate and its associated switch operator shaft. This moves one of the switches between the open and closed conditions without actuation of the other switch.

BRIEF DESCRIPTION OF THE DRAWINGS

FIG. 2 is an end elevational view of the switches of FIG. 1;

FIG. 3 is a partial view taken along line 3—3 of FIG. 2;

DESCRIPTION OF THE PREFERRED EMBODIMENTS

Figure 1:
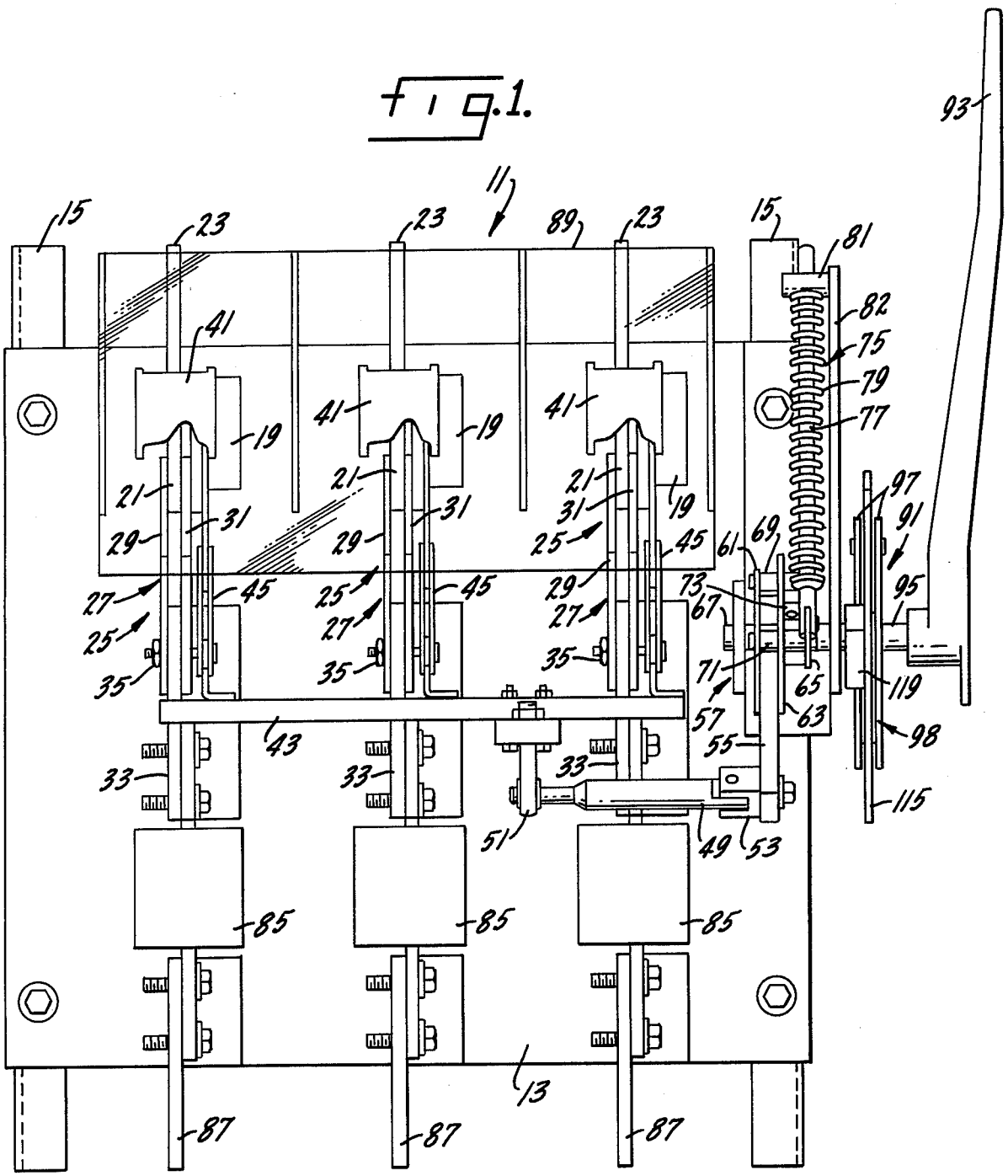
FIG. 1 is a front elevational view of a pair of load-break bolted pressure contact switches positioned back to back and operatively connected by a dual switch actuator mechanism in accordance with the teachings of this invention.

FIGS. 1, 2, 3 and 4 of the drawings illustrate a pair of load-break bolted pressure contact switches 11, of known construction, positioned back to back and connected for co-ordinated operation in accordance with this invention. Switches of this type are illustrative of high-current switches to which this invention is directed. Each switch 11 includes a base member 13 fabricated from a suitable insulating material. The base members 13 of the back to back switches are bolted to vertical metal channels 15 positioned between the base members adjacent opposite ends thereof.

At the top of each base member 13, there are mounted three spaced fixed contact members 19. Each of the fixed contact members 19 is provided with an outwardly projecting contact blade 21 and a terminal lug 23. Each of the fixed contact members 19 is one element of a pole 25 of a switch 11. Each fixed contact 19 is engageable by a movable contact 27. Each of the movable contacts 27 of a pole comprises a pair of contact blades 29 and 31. Each pair of contact blades 29 and 31 is pivotally mounted on a terminal lug 33 by means of a suitable pivot member 35 including a bolt and nut.

An arc chute 41 is mounted on each fixed contact member 19. A suitable arc chute is shown in U.S. Pat. No. 3,441,699, but the invention should not be limited to the use of the particular arc chute shown in that patent since that arc chute is merely illustrative of one of a number of different forms of arc chutes which may be used.

Each switch 11 further includes an actuating bar 43 that extends transversely of the switch and is connected to each of the movable contacts 27 by means of a connecting linkage 45 so that arcuate movement of the actuating bar with respect to the pivotal connection of the movable contacts 27 drives the movable contact of the switch pivotally into and out of engagement with the fixed contacts 19.

Switches 11, as thus far described, correspond generally to the construction of the load-break bolted pressure contact switch described and claimed in U.S. Pat. No. 3,213,247. The present invention is not directed to the switch structure per se, and should not be construed as limited to use with the particular load-break switch structure of U.S. Pat. No. 3,213,247 or with the switch structure shown herein, both of which are merely illustrative of several of a number of different forms of switches in which the invention may be incorporated.

The actuating bar 43 of each switch 11 is connected to an operating rod 49 by means of a socket type universal connection 51. A connector of this type is marketed under the designation "ALINABAL. " The opposite end of each operating rod 49 is pivotally connected to a clevis 53 mounted on one side of an operating lever 55 at the free end thereof. The operating lever 55 may be formed of a suitable insulating material and its rotation is controlled by a lost motion switch operator mechanism 57. The lost motion switch operator mechanism 57 may take many forms, one of which is shown in application Ser. No. 805,597 filed June 10, 1977, which is assigned to the same assignee as this application. However, the present invention is not directed to the lost motion switch operator mechanism per se and should not be construed as limited to use with the particular lost motion switch operator mechanism shown in said co-pending patent application which is merely illustrious of one of several of a number of different forms of switch operator mechanisms in which the invention of this application may be incorporated.

The lost motion switch operator mechanism 57 includes spaced plates 61, 63 and 65 which are rotatably mounted on a switch operator shaft 67. The plates are connected by three pins, two of which, pins 69 and 71, are shown in the drawings herein. A crank arm 73 is rigidly fixed to shaft 67 and rotates therewith to engage the pins extending between and connecting the plates. After a suitable amount of rotation of the mechanism, the pins will engage the operating lever 55 and cause it to rotate.

An overcenter spring mechanism 75 is pivotally connected to the follower plate 65 of the lost motion switch operator mechanism. The overcenter spring mechanism is of the toggle type and includes a drive rod 77 extending through a coil spring 79. The upper end of the drive rod is slidably and pivotally mounted in an opening (not shown) formed in the apex of the inverted V-shaped support 81 which is fastened to the upper end of a bracket 82 which is attached to the base member 13. The coil spring 79 is captured between the V-shaped support 81 and a stop pin and washer (not shown) positioned near the lower end of the drive rod. The lower end of the drive rod is pivotally connected to the follower plate 65 of the lost motion connection by means of a pivot pin (not shown) which rides in an elongated slot (not shown) in the follower plate 65.

The switch operator shaft 67 is journalled in the support bracket 82 and extends outwardly beyond the support bracket where it is attached to the dual switch actuator mechanism of this invention. As is most clearly shown in FIGS. 2, 3 and 4 of the drawings, a switch operator shaft 67 is provided for each switch 11.

Appropriate overload fuses 85 are installed between lugs 33 and terminal lugs 87. A transparent protective shield 89 of the type described and claimed in co-pending application Ser. No. 768,167, filed Feb. 14, 1977, is shown positioned in front of the switch contacts of each switch 11.

The dual switch actuator mechanism 91 of this invention joins the shafts 67 of the lost motion switch operator mechanisms 57 of the switches 11 for co-ordinated actuation. This mechanism 91 includes an operating handle 93 affixed to a main shaft 95 which is journalled in one of the channels 15 and extends is paraxial spaced relation to the shafts 67. It should be understood that a drive motor, a hand wheel or other mechanism may be substituted for the operating handle 93. A drive plate assembly 98 comprising a pair of spaced drive plates 97 is affixed to the main shaft 95 by a drive block 99. The plates 97 are joined by an inner plate 101 which has an arcuate bearing surface 103. The assembly 98 comprising plates 97, block 99, and plate 101 is held together by a fastener 105. Drive pins 109 and 111 extend between the drive plates 97 at locations outwardly of the inner plate 101 with the drive pins being held in position by clips 113 which fit into slots (not shown) formed in the pins. As can be most clearly seen in FIG. 2 of the drawings, the drive pins 109 and 111 are located symmetrically with respect to the main shaft 95.

A modified Geneva follower plate 115 is rigidly connected to each switch operator shaft 67 by means of a pin 117 which fastens the shaft to a block 119 which in turn is connected by a fastener 121 to the modified Geneva follower plate. The Geneva follower plate 115 is somewhat triangular in shape, with the shaft being connected to the plate near the center of the triangular base. An outwardly opening radial slot 123 is formed in the plate and extends from near the peak towards the switch operator shaft 67. A second outwardly opening radial slot 125 is located at an angle of less than 90° relative to the slot 123 and also is aligned with the shaft 67. One side wall of the follower plate 115 forms an arcuate bearing surface 127 which is complementary to bearing surface 103 of the inner drive plate 101. A stop surface 129 is formed on the Geneva follower plate 115 adjacent one end of the arcuate bearing surface 127.

In considering the operation of the dual switch actuator mechanism 91 of this invention, it may be assumed that both switches 11 are open, as shown in FIGS. 1 and 2 of the drawings. Under these circumstances, the operating handle 93 is in the vertical or neutral position shown in the drawings, with the drive pins 109 and 111 positioned near the entrances of the slots 123 of the Geneva follower plates 115. Assume the operating handle 93 is rotated in a clockwise direction, as viewed in FIGS. 2 and 4 of the drawings, through an arc of approximately 135° to position 93A shown in dashed lines. During the clockwise rotation of the main shaft 95, which is attached to the handle 93, the drive pin 111 first moves radially inwardly of the slot 123 of the Geneva follower plate 115 on the right hand side of the mechanism, rotating that follower plate in a counterclockwise direction. As the shaft 95 continues to rotate in a clockwise direction, with the drive pin 111 moving inwardly along the slot 123 of the right hand Geneva follower plate, the other drive pin 109 moves out of the slot 123 of the Geneva follower plate on the left side of the main shaft 95. At the same time, the arcuate bearing surface 103 of the inner drive plate 101 moves out of contact with the arcuate bearing surface 127 of the Geneva follower plate 115 on the right hand side of the handle. However, bearing surface 103 remains in contact with the arcuate bearing surface 127 of the Geneva follower plate on the left hand side of the main shaft 95.

Continued clockwise movement of the main shaft 95 subsequently moves the drive pin 111 out of the slot 123 of the Geneva follower plate being rotated and brings the other drive pin 109 into the slot 125 of the same Geneva follower plate. Clockwise rotation of the main shaft 95 is stopped when the drive pin 111 engages the stop surface 129 on the Geneva follower plate 115 which is not being rotated. The final position of the main shaft 95 is shown in FIG. 4.

Figure 4:
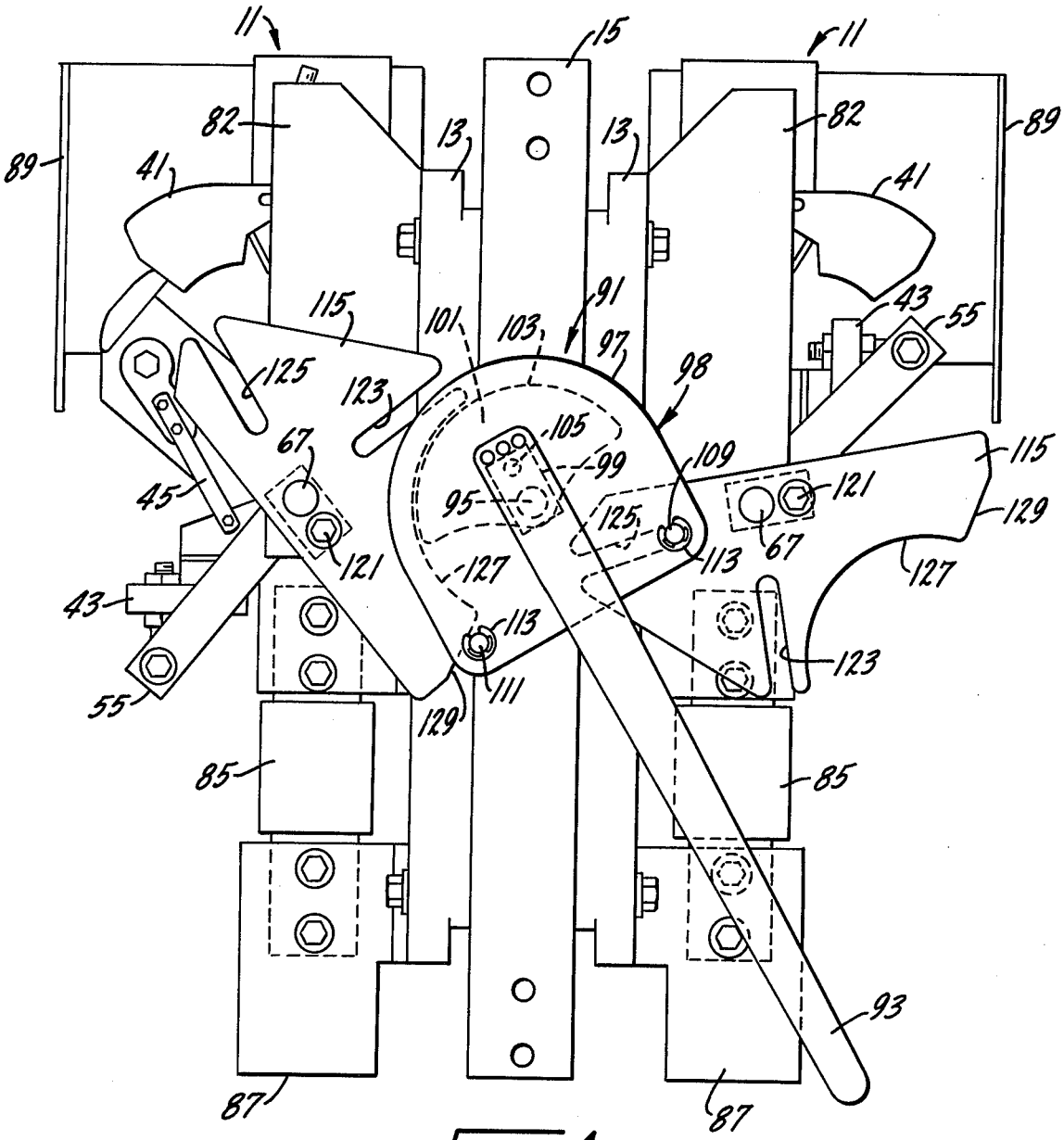
FIG. 4 is a view similar to that of FIG. 2 but showing the dual switch actuator mechanism in one actuated position.

During the entire period of rotation of the Geneva plate 115 on the right hand side of the main shaft 95 as viewed in FIGS. 2 and 4, the opposite Geneva follower plate will be held against rotation by engagement of the arcuate surface 103 of the inner drive plate 101 of the main shaft 95 with the complementary bearing surface 127 formed on the Geneva follower plate.

Rotation of the Geneva follower plate 115 on the right hand side of main shaft 95 in a counterclockwise direction rotates the shaft 67 of the switch operator mechanism 57 in a counterclockwise direction. Rotation of the shaft 67 will actuate the overcenter toggle mechanism 75 to move the operating lever 55 from its lowered position as shown in FIGS. 1 and 2 to its upper position, shown in FIG. 4 of the drawings, closing the switch 11 located on the right hand side of the main shaft 95.

When the main shaft 95 is rotated from its position of FIG. 4 to its neutral position as shown in FIGS. 1–3, the operation of the switch 11 on the right hand side thereof will be reversed with the switch being moved from its closed to its open position.

Operation of the switch on the left hand side of the operating handle 93, as shown in FIGS. 2 and 4, is accomplished by rotating the handle in a counterclockwise direction to position 93B shown in dashed lines in FIG. 2. It should be noted that the dual switch actuator 91 of this invention permits the operation of only one of the two switches 11 at any one time, in a break-before-make action.

Figure 5:
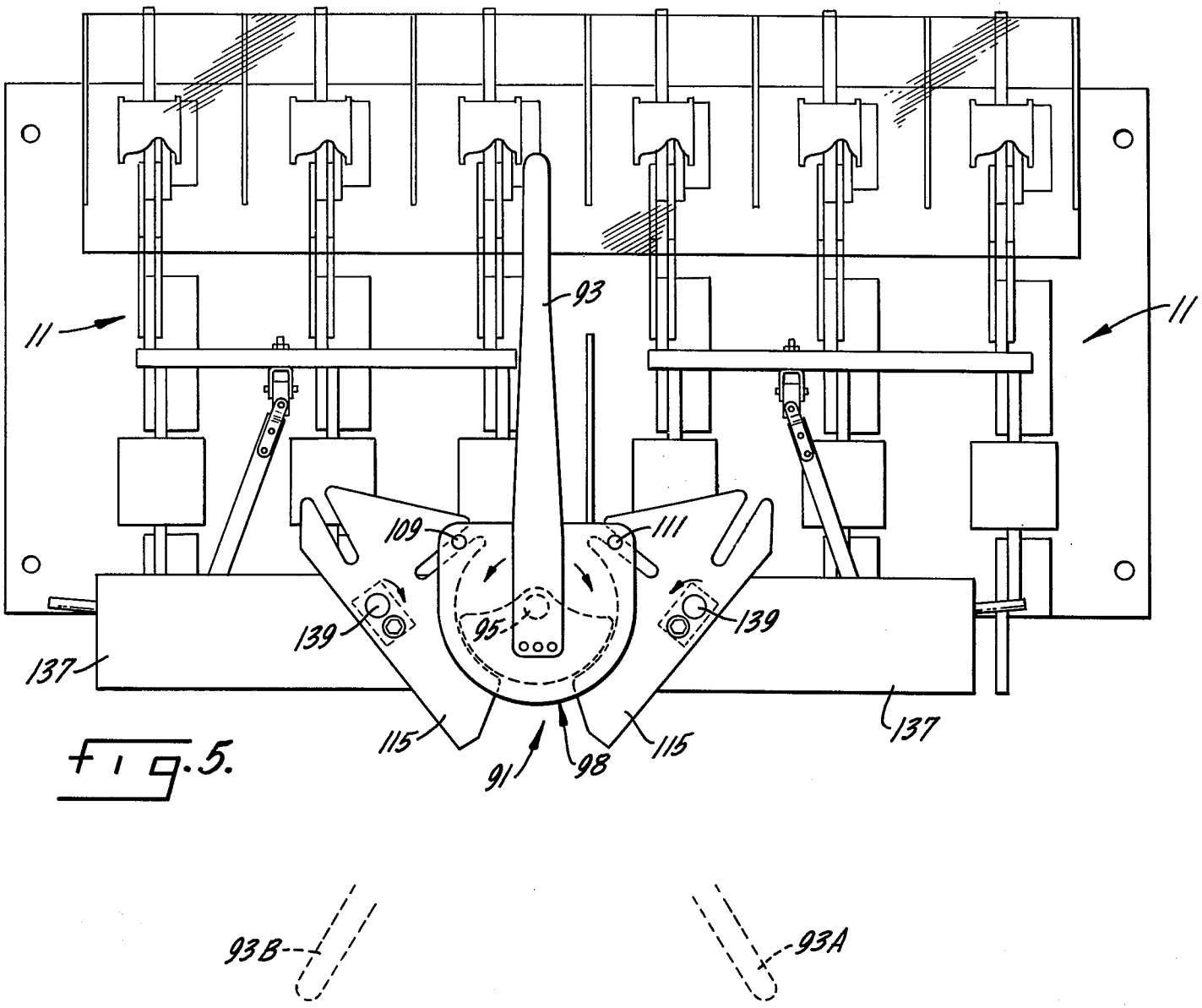
FIG. 5 is a front elevational view of two switches mounted side by side and operatively connected by the dual switch actuator mechanism of this invention with the alternate positions of the operating handle of the dual switch actuator mechanism shown in phantom.

FIG. 5 of the drawings shows a dual switch actuator mechanism 91 of the invention operatively connected to two high current switches 11 which are positioned side by side. The dual switch actuator mechanism is located at the front of the switches. The dual switch actuator mechanism 91 is identical to and operates in the same manner as the mechanism shown and described in the embodiment of FIGS. 1 through 4 of this specification. However, the switch operator mechanisms are somewhat different than those shown and described in the embodiment of FIGS. 1 through 4. The switch operator mechanisms 137 are of the type shown in U.S. Pat. No. 3,522,401 and each has a shaft 139 which is similar to shaft 67 of switch operator mechanism 57.

In operation, clockwise rotation of the shaft 95 of the dual switch operator mechanism 91 from the neutral position shown in FIG. 5 to the position of the handle 93 indicated by dashed lines are 93A causes counterclockwise revolution of the right hand modified Geneva follower plate 115 and closing of the right hand switch 11. Rotation of the main shaft 95 in a counterclockwise direction, as viewed in FIG. 5, rotates the handle 93 to the position indicated by dashed lines as 93B and causes clockwise rotation of the left hand modified Geneva follower plate 115 and closing of the switch 11 on the left hand side of the main shaft 95.

It should be understood and appreciated that the dual switch actuator mechanisms 91 shown in FIGS. 1 through 5 can be installed in an inverted position relative to the switches 11. With a dual switch actuator mechanism 91 installed in an inverted position, the contacts of the switches 11 would be closed in the neutral position of the main shaft 95. Also, the slots 123 and 125 of a Geneva follower plate 115 would be facing downward in the neutral position of the main shaft 95 and the drive pins 109 and 111 would be positioned below the main shaft 95. When so arranged, rotation of the main shaft 95 in a clockwise direction from its neutral position would rotate the left hand switch operator shaft in a counterclockwise direction to open the left hand switch. Likewise, rotation of the main shaft 95 in a counterclockwise direction from its neutral position would rotate the right hand switch operator shaft clockwise to open the right hand switch. This inverted installation of the mechanism 91 can be applied both to the back to back switches which are shown in the embodiment of FIGS. 1–4 and to the side by side switches of FIG. 5 to afford a make-before-break action.

The dual switch actuator mechanism 91 of this invention may also be arranged to control the operation of switches which are positioned side by side or back to back through sequences of operation other than the particular sequence previously described in which both switches are in their open position in the neutral position of the switch actuator mechanism or, when the switch actuator mechanism is inverted, both of the switches are in their closed position in the neutral position of the switch actuator mechanism. An example of a different sequence would be where one switch is closed and the other is open when the switch actuator is in its neutral position. In this situation, rotation of the switch actuator in one direction would open both switches and rotation in the opposite direction would close both switches.

The same sequence of operation could be accomplished when the switch actuator is installed in its inverted position. This can be done by modifying the switch operator mechanisms so that rotation of a switch operator mechanism in one direction provides a different operating movement of the switch. For example, consider the embodiment of FIGS. 1 through 4, in which the switches 11 are both open at the neutral position of the switch actuator mechanism shaft 95. To close the right hand switch, the main shaft 95 is rotated clockwise and the switch operator mechanism shaft 67 of the right hand switch rotates counterclockwise. To close the left hand switch, the main shaft 95 is rotated counterclockwise and the switch operator mechanism shaft 67 of the left hand switch rotates clockwise.

Now, assume that the right hand switch 11 is closed and the left hand switch 11 is open at the neutral position of the main shaft 95. Also, assume that the switch operator 57 of the right hand switch is modified so that its shaft 67 must be turned counterclockwise to open the right hand switch. Thus, to open the right hand switch 11, the main shaft 95 is rotated clockwise and its switch operator mechanism shaft 67 moves counterclockwise. When the switch operator mechanism shaft 95 is rotated counterclockwise, the switch operator mechanism shaft 67 of the left hand switch rotates clockwise and closes the left hand switch. This is the conventional operation of the switch operator mechanism shaft previously described.

Other operational arrangements of high current switches may be obtained by various combinations of the dual switch actuator mechanisms with modified switch operator mechanisms.

The previously described dual switch actuator mechanism 91 required the shaft 95 to rotate through an arc of approximately 135° and causes an approximately similar rotational arc of the switch operator shaft 67. The modified switch actuator mechanism 151 shown in FIGS. 6 through 9 of the drawings, is intended for use in applications in which it is necessary or desirable to limit the angular rotation of the switch operator mechanism shaft. For clarity, the switches 11 and their switch operator mechanisms have been omitted from the drawings. The modified switch actuator mechanism 151 requires an angular rotation of its main shaft 153 of only approximately 90° from fully open to fully closed positions.

The modified switch actuator mechanism 151 includes drive plates 155 located on opposite sides of an inner plate 157. The inner plate has an arcuate bearing surface 159. The drive plates and inner plates are connected to the main shaft 153 and to a handle 161 by a drive block 163 and a fastener 165. Drive pins 169 and 171 extend between the drive plates 155 at locations positioned outwardly of the inner plate 157. The drive pins may be connected to the drive plates in any conventional manner. The drive pins 169 and 171 are positioned symmetrically with respect to the main shaft 153.

Two modified Geneva follower plates 175 of smaller size than the Geneva follower plates 115, are affixed to the switch operator mechanism shafts 67 of two switches (not shown). Each shaft 67 may be part of a switch operator mechanism 57 of the type shown in the embodiments of FIGS. 1 through 4 or of the type 137 shown in FIG. 5. Each Geneva follower plate 175 is fastened to the switch operator shaft by means of a pin 191 which fastens the shaft to a block 193 which in turn is connected by a fastener 195 to the follower plate 175. The Geneva follower plate 175 is somewhat irregular in shape with the connection to the switch operator shaft being located near the center of the plate. An outwardly opening slot 197 is formed in each plate 175 and extends radially inwardly toward the switch operator shaft. Another shorter radial slot 199 is formed in each plate; slots 197 and 199 are displaced by an angle slightly less than 90°. One side wall of the plate 175 forms an arcuate bearing surface 201 which is complementary in shape to the bearing surface 159 of the inner drive plate 157.

Figure 6:
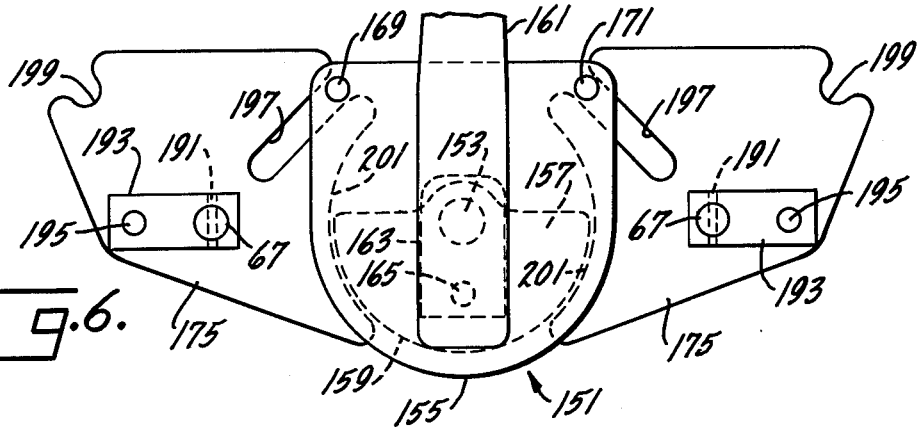
FIG. 6 is a partial front view of a modified dual switch actuator mechanism of this invention.
Figure 7:
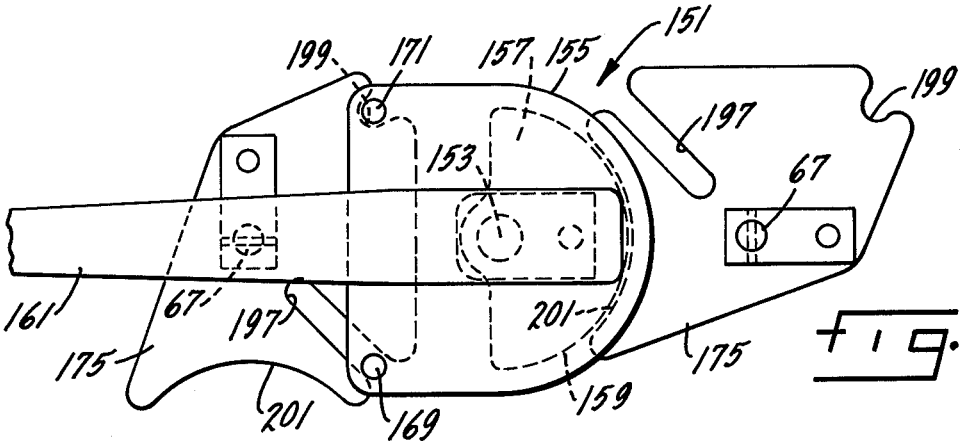
FIG. 7 shows the mechanism of FIG. 6 with the actuator mechanism in one actuating position.

The dual switch actuator mechanism 151 is shown in its neutral position in FIG. 6 of the drawings. In this position, the handle 161 is in its vertical position. When the handle is moved in a counterclockwise direction as viewed in FIG. 6, through an angle of 90° to the position of FIG. 7, the drive pin 169 engages the slot 197 of the left hand follower plate 175 and rotates the Geneva follower plate 175 in a clockwise direction until the other drive pin 171 engages and seats in the opposite slot 199. During this rotation of the main shaft 153, the arcuate bearing surface 159 of the inner drive plate 157 engages the arcuate bearing surface 201 of the right hand Geneva follower plate 175, holding it against rotation. It should be noted that with this modified switch actuator mechanism, rotation of the shaft 153 through an arc of approximately 90° moves the switch operator shaft 67 to which the left-hand Geneva follower plate 175 is attached through an arc of approximately 90°. Of course, the main shaft 153 may also be rotated in a clockwise direction to actuate the right-hand Geneva follower plate 175 with clockwise rotation of the shaft 153 causing counterclockwise rotation of the right hand Geneva follower plate 175 and the switch operator mechanism shaft 67 which is attached thereto.

Figure 8:
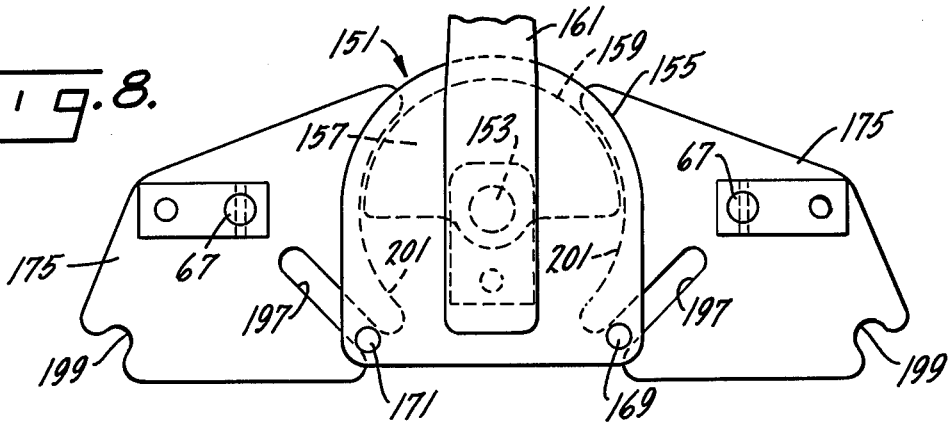
FIG. 8 is a partial view showing a modified dual switch actuator mechanism having follower plates in an inverted position relative to those of FIG. 6.
Figure 9:
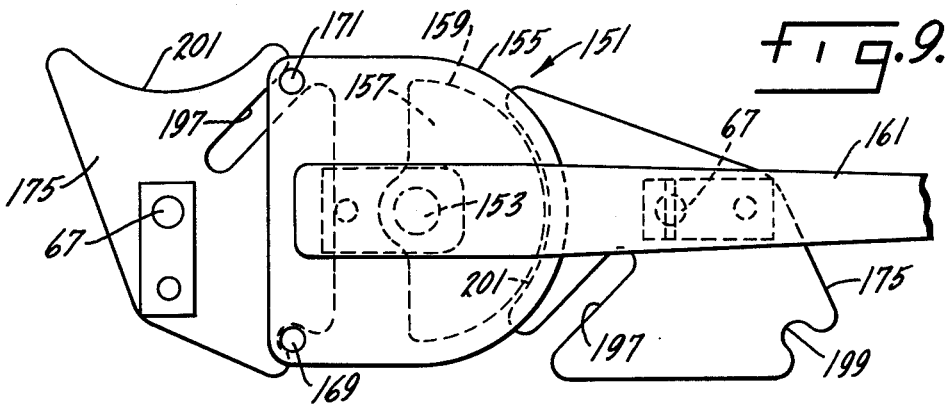
FIG. 9 is a view of the mechanism of FIG. 8 with the dual switch actuator mechanism in one of its actuated positions.

FIGS. 8 and 9 of the drawings show the modified switch actuator mechanism 151 mounted in an inverted position. In the inverted position, as previously explained, clockwise rotation of the main shaft 153 will cause counterclockwise rotation of the Geneva follower plate 175 on the left hand side of the assembly, as viewed in the drawings, and counterclockwise rotation of shaft 153 will cause clockwise rotation of the Geneva follower plate 175 on the right hand side.

We claim:

1. A dual switch actuator mechanism for coordinated actuation of two high-current switches, each switch including a switch operator mechanism for opening and closing the switch in response to rotation of a switch operator shaft in opposed directions, the switches being mounted adjacent each other with the switch operator shafts in aligned paraxial spaced relation to each other, the dual switch actuator mechanism comprising:

a rotatable main shaft, positioned between and in aligned paraxial relation to the two switch operator shafts;

a Geneva drive plate affixed to the main shaft for rotation therewith and having an arcuate bearing surface;

a pair of drive pins mounted in spaced relation to each other on the drive plate;

two modified Geneva follower plates, each affixed to the switch operator shaft of a respective switch operator mechanism, each follower plate having a drive slot for receiving one of the drive pins and each follower plate further having an arcuate bearing surface complementary to the drive plate bearing surface;

the follower plates being aligned, relative to the main shaft and drive plate, so that for a given neutral position of the main shaft, each drive pin is positioned in the entrance of a follower plate drive slot and the bearing surfaces of both follower plates engage the drive plate bearing surface, rotation of the main shaft through a predetermined arc in either direction from the neutral position causing one guide pin to move inwardly of the drive slot of one follower plate to rotate that follower plate and its associated switch operator shaft and thereby actuate one of the switches between open and closed conditions without actuation of the other switch.

2. The dual switch actuator mechanism of claim 1 in which a second slot is formed in each modified Geneva follower plate and positioned so that with continued rotation of the drive plate, the second drive pin enters the second slot during rotation of the modified Geneva follower plate.

3. The dual switch actuator mechanism of claim 2 in which the second guide pin moves inwardly of the second slot to continue rotation of that follower plate and its associated switch operator shaft.

4. The dual switch actuator mechanism of claim 1 in which rotation of the main shaft in either direction from the neutral position is stopped by engagement of one of the drive pins with one of the follower plates.

5. The dual switch operator mechanism of claim 4 in which rotation of the main shaft is stopped by engagement of the second drive pin in the second slot of the follower plate being rotated.

6. The dual switch operator mechanism of claim 4 in which by rotation of the main shaft is stopped by engagement of the first drive pin with a stop surface on the follower plate not being rotated.

7. The dual switch actuator mechanism of claim 1 in which the drive plate bearing surface is moved out of contact with the arcuate bearing surface of the follower plate being rotated during rotation of the main shaft through the predetermined arc.

8. The dual switch actuator mechanism of claim 1 in which the drive plate bearing surface remains in contact with the arcuate bearing surface of the follower plate not being rotated during rotation of the main shaft through the predetermined arc.

9. The dual switch actuator mechanism of claim 1 in which the two high-current switches are positioned back to back and the dual switch actuator mechanism is positioned on one side of the switches.

10. The dual switch actuator mechanism of claim 1 in which the two high-current switches are positioned side by side and the dual switch actuator mechanism is positioned in front of the switches.

11. The dual switch actuator mechanism of claim 1 in which the drive pins are located above the main shaft in the neutral position of the main shaft.

12. The dual switch actuator mechanism of claim 1 in which the drive pins are located below the main shaft in the neutral position of the main shaft.

* * * * *